US009314704B2

(12) United States Patent
Ostendorff

(10) Patent No.: US 9,314,704 B2
(45) Date of Patent: Apr. 19, 2016

(54) TOY VEHICLE TRACK SET

(71) Applicant: Mattel, Inc., El Segundo, CA (US)

(72) Inventor: Eric Ostendorff, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 70 days.

(21) Appl. No.: 14/043,900

(22) Filed: Oct. 2, 2013

(65) Prior Publication Data

US 2014/0097262 A1 Apr. 10, 2014

Related U.S. Application Data

(60) Provisional application No. 61/710,048, filed on Oct. 5, 2012.

(51) Int. Cl.

*A63H 19/30* (2006.01)
*A63H 13/04* (2006.01)
*A63H 18/02* (2006.01)

(52) U.S. Cl.

CPC ..... *A63H 18/028* (2013.01); *A63H 18/025* (2013.01)

(58) Field of Classification Search

CPC ..... A63H 13/00; A63H 13/04; A63H 17/00; A63H 17/004; A63H 18/00; A63H 18/02; A63H 18/025; A63H 18/04; A63H 18/06

USPC ..... 238/10 R, 10 A, 10 B, 10 C, 10 F; 446/275, 429, 430, 435

See application file for complete search history.

(56) References Cited

U.S. PATENT DOCUMENTS

| | | | |
|---|---|---|---|
| 276,539 | A | 4/1883 | Reed |
| 284,965 | A | 9/1883 | Ireland |
| 621,659 | A | 3/1899 | Halder |
| 1,235,771 | A | 8/1917 | Dettra |
| 1,282,358 | A | 10/1918 | Arden |
| 1,437,699 | A | 12/1922 | Wylie |
| 2,385,724 | A | 9/1945 | Olson |
| 2,442,526 | A | 6/1948 | Wright |
| 2,457,653 | A | 12/1948 | Froelich |
| 2,503,877 | A | 4/1950 | Kuemmerlein et al. |
| 3,012,367 | A | 12/1961 | Neumann |
| 3,621,602 | A | 11/1971 | Barcus et al. |
| 4,661,080 | A | 4/1987 | Goldstein et al. |
| 4,734,076 | A | 3/1988 | Goldstein et al. |
| 4,810,224 | A | 3/1989 | DeVincent |
| 4,867,723 | A | 9/1989 | Asbach |

(Continued)

*Primary Examiner* — R. J. McCarry, Jr.

(74) *Attorney, Agent, or Firm* — Edell, Shapiro & Finnan, LLC

(57) ABSTRACT

A track set for toy vehicles having: a base member; a loop section defined by a plurality of curved segments, each of the curved segments being releasably secured to at least another one of the curved segments at one end when the loop section is defined by the curved segments, each of the curved segments includes a feature at the one end for engagement with another one of the curved segments or the base member of the track set; and a release mechanism being movably secured to the loop section, the release mechanism being capable of movement between a first position in which the curved segments are secured to each other and a second position in which the curved segments are released from each other, wherein a portion of the release mechanism is positionable in a portion of a path defined by the loop section such that an object travelling along the path can move the release mechanism from the first position to the second position.

20 Claims, 14 Drawing Sheets

(56) References Cited

U.S. PATENT DOCUMENTS

| | | | |
|---|---|---|---|
| 4,895,548 | A | 1/1990 | Holland et al. |
| 4,979,926 | A | 12/1990 | Bisceglia |
| 5,074,819 | A | 12/1991 | Stadnyk |
| 5,183,427 | A | 2/1993 | Draper |
| 5,234,216 | A | 8/1993 | Ostendorff |
| 5,380,231 | A | 1/1995 | Brovelli |
| 5,397,260 | A | 3/1995 | Tilbor et al. |
| 5,906,528 | A | 5/1999 | Ostendorff et al. |
| 6,086,449 | A | 7/2000 | Sharp |
| 6,149,485 | A | 11/2000 | Christiansen |
| 6,358,112 | B1 | 3/2002 | Lambert et al. |
| 6,913,508 | B2 | 7/2005 | Hornsby et al. |
| 7,628,673 | B2 | 12/2009 | Bedford et al. |
| 7,794,301 | B2 | 9/2010 | Ostendorff et al. |
| 7,857,679 | B2 | 12/2010 | O'Connor et al. |
| 7,892,068 | B2 | 2/2011 | Nuttall et al. |
| 2005/0287919 | A1* | 12/2005 | Sheltman et al. ..... 446/444 |
| 2010/0041305 | A1 | 2/2010 | O'Connor |
| 2010/0330868 | A1 | 12/2010 | Payne |

* cited by examiner

TOY VEHICLE TRACK SET

CROSS REFERENCE TO RELATED APPLICATIONS

This application claims the benefit of U.S. provisional patent application Ser. No. 61/710,048 filed Oct. 5, 2012, the contents of which are incorporated herein by reference thereto.

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on these play set tracks and propelled across the configuration by hand or by an external propulsion means.

To bring increased entertainment and excitement to play sets, track configurations may include features such as intersecting tracks, loop segments, and other types of track configurations.

Accordingly, a play set for toy vehicles that provides variations in play is desired.

BRIEF SUMMARY OF INVENTION

In one embodiment, a track set for toy vehicles is provided, the track set having: a base member; a loop section defined by a plurality of curved segments, each of the curved segments being releasably secured to at least another one of the curved segments at one end when the loop section is defined by the curved segments, each of the curved segments includes a feature at the one end for engagement with another one of the curved segments or the base member of the track set; and a release mechanism being movably secured to the loop section, the release mechanism being capable of movement between a first position in which the curved segments are secured to each other and a second position in which the curved segments are released from each other, wherein a portion of the release mechanism is positionable in a portion of a path defined by the loop section such that an object travelling along the path can move the release mechanism from the first position to the second position.

In another embodiment, a track set for toy vehicles is provided, the track set having: a loop section defined by a plurality of curved segments each being releasably secured to each other, each of the curved segments being releasably secured to at least another one of the curved segments at one end when the loop section is defined by the curved segments, each of the curved segments including a feature at the one end for engagement with another one of the curved segments; a base member; and a trigger mechanism mounted on the base member, the trigger mechanism being configured to release a first one of the plurality of independent curved segments from the base member such that each one of the plurality of independent curved segments sequentially dislodges from one each other.

In still another embodiment, a toy vehicle track set is provided. The toy vehicle track set having: a base member; a loop section removably coupled to the base member, the loop section including a first curved track segment, a second curved track segment, and a third curved track segment, the first curved track segment removably coupled at one end to the base member, the third curved track segment removably coupled at one end to the base member, the second curved track segment removably coupled to the first curved track segment and to the third curved track segment, the loop section including a biasing member; a trigger mechanism coupled to the base member, the trigger member being engageable by a toy vehicle, wherein actuation of the trigger member by a toy vehicle results in the release of the track segments and the track segments move apart due to the force of the biasing member.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1A:
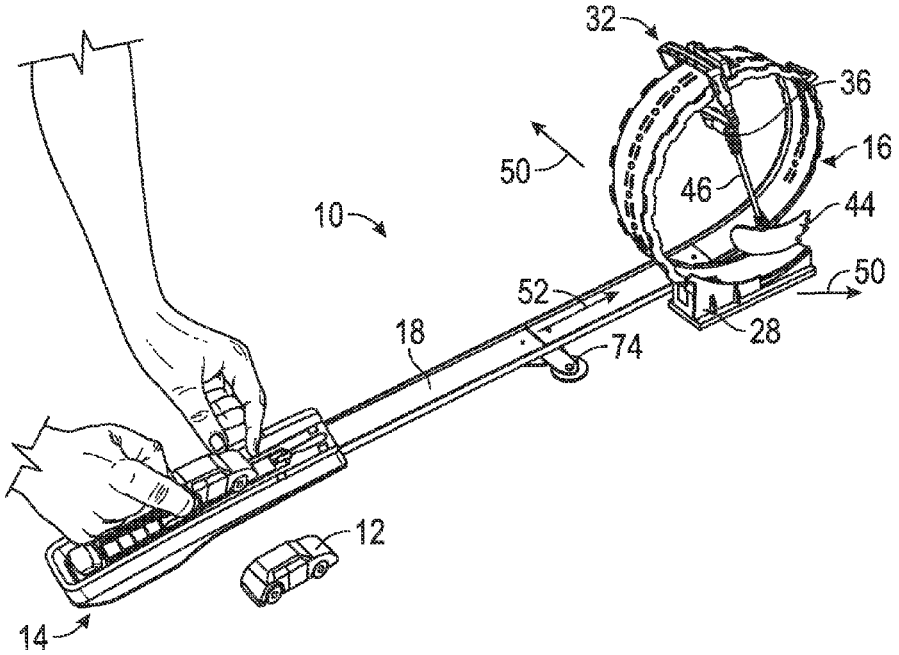
FIG. 1A is a perspective view of a play set according to an exemplary embodiment of the present invention wherein a loop section is defined by a plurality of curved segments releasably secured to each other.
Figure 1B:
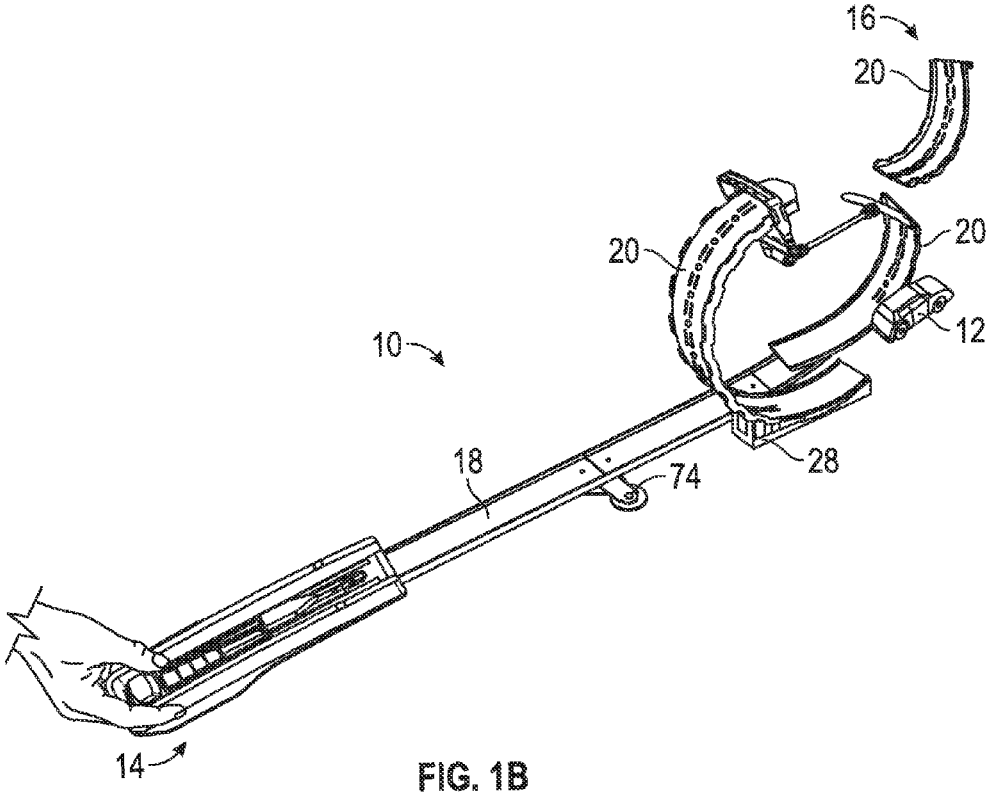
FIG. 1B is a perspective view of the play set of FIG. 1A wherein the loop section is no longer defined by the curved segments as they are released from each other.
Figure 2A:
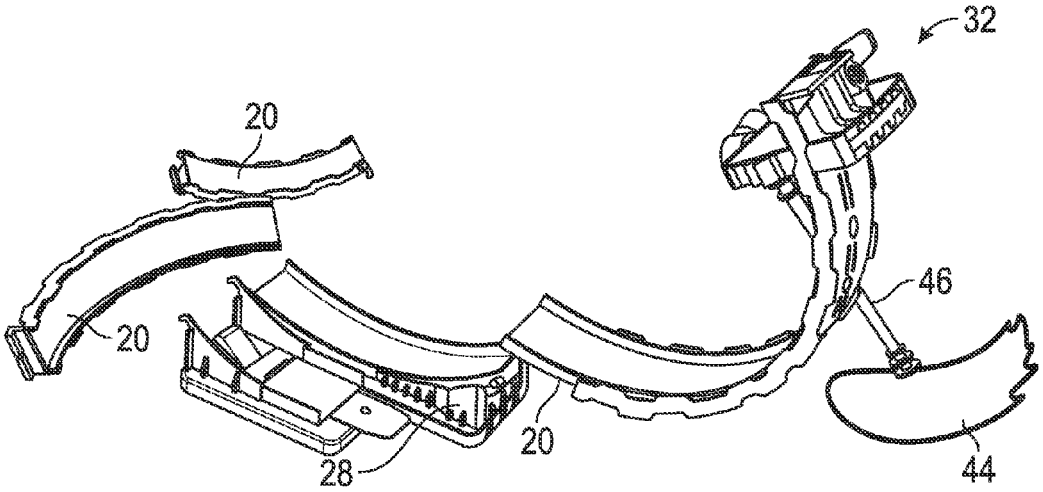
FIGS. 2A-2D illustrate the assembly of the loop section of the play set of FIG. 1A in accordance with one exemplary embodiment of the present invention.
Figure 2B:
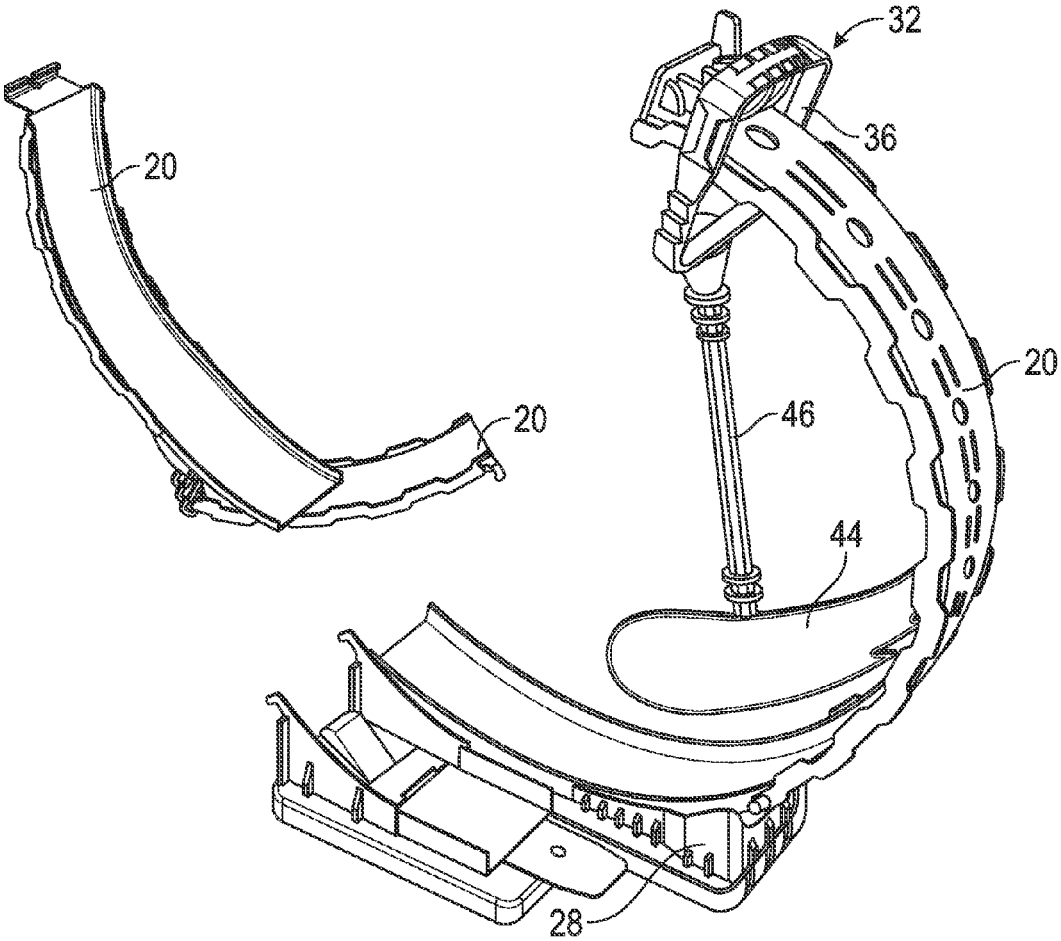
Figure 2C:
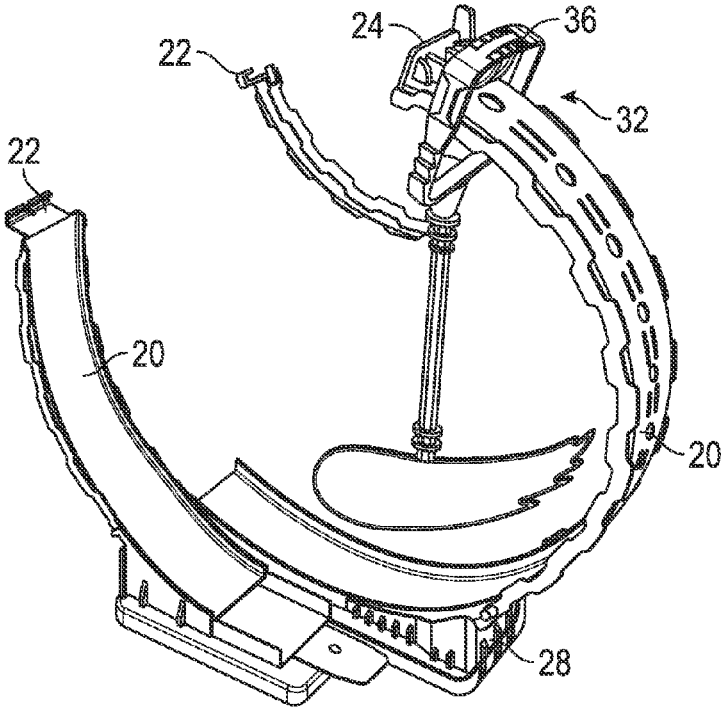
Figure 2D:
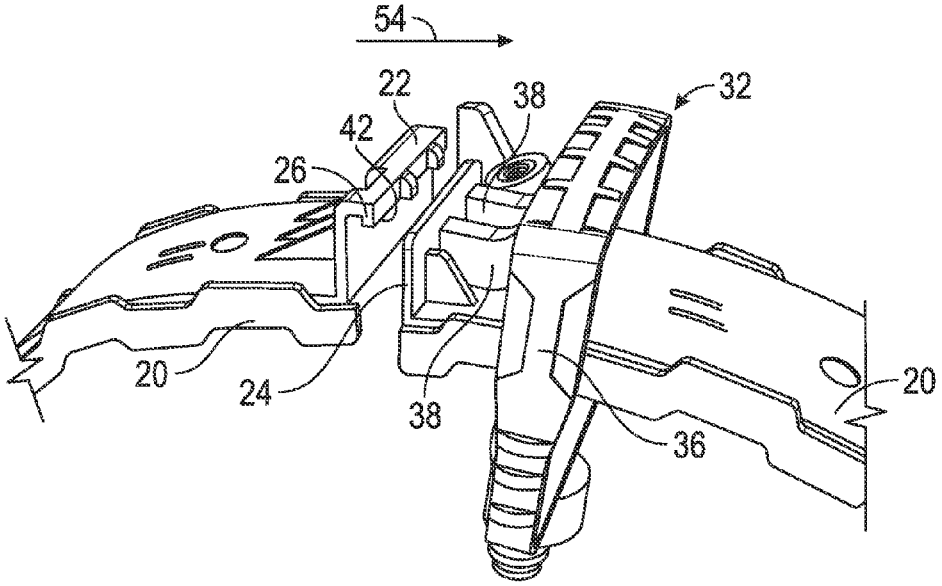

FIGS. 1A and 1B show an exemplary play set or track set 10 for toy vehicles or objects 12 according to one non-limiting embodiment of the present invention. The play set 10 includes a launcher 14, a loop section 16 and a track segment 18 extending between the launcher 14 and the loop section 16.

Launcher 14 is configured to launch an object or toy vehicle 12 along a path defined by the track set 10. Launcher 14 may be any launcher known to those skilled in the related arts as well as the launchers described in U.S. Pat. Nos. 4,108,437; 6,435,929; and 7,934,970 and U.S. Patent Publication No. 2007/0293122, the contents of each of which are incorporated herein by reference.

The loop section 16 is defined by several independent curved segments 20 that are releasably secured to adjacent curved segments 20 (see FIG. 1B). Each one of the curved segments 20 is releasably secured to another one of the curved segments 20 at one end when the loop section 16 is defined by the curved segments 20. Each curved segment 20 has a feature 22 at the one end for engagement with a feature 24 of another track segment 20. The features 22 and 24 can be referred to alternatively as couplers or coupling members. In one non-limiting embodiment, feature 22 has a "hook like" configuration that defines an area 26 for releasably receiving feature 24. (See at least FIG. 2D and FIGS. 4A-4D)

Figure 3:
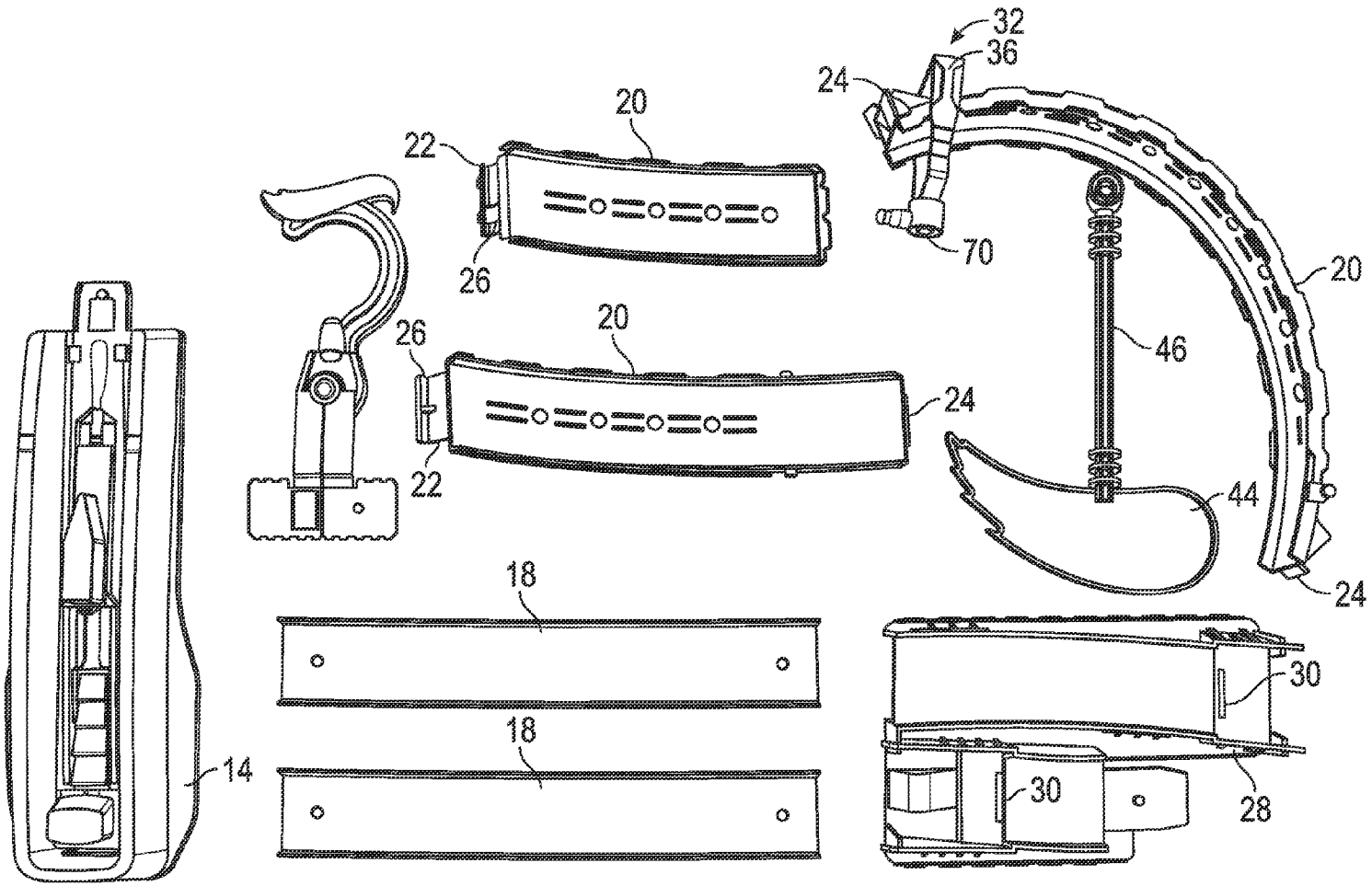
FIG. 3 illustrates components of the track set of FIG. 1A in accordance with an embodiment of the present invention.
Figure 4A:
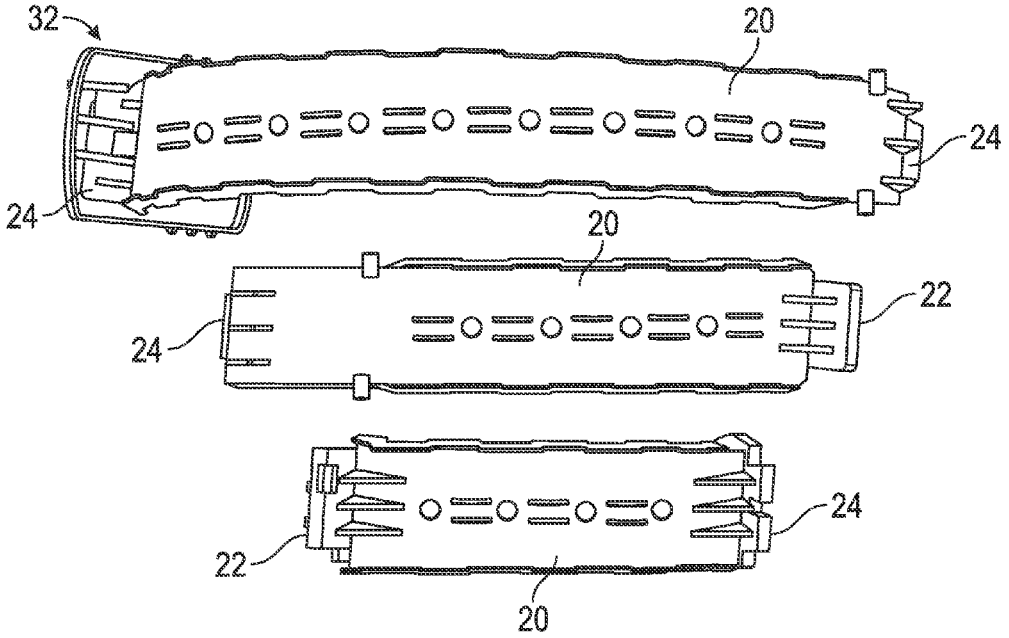
FIGS. 4A-4F are various views of the curved segments according to one embodiment.
Figure 4B:
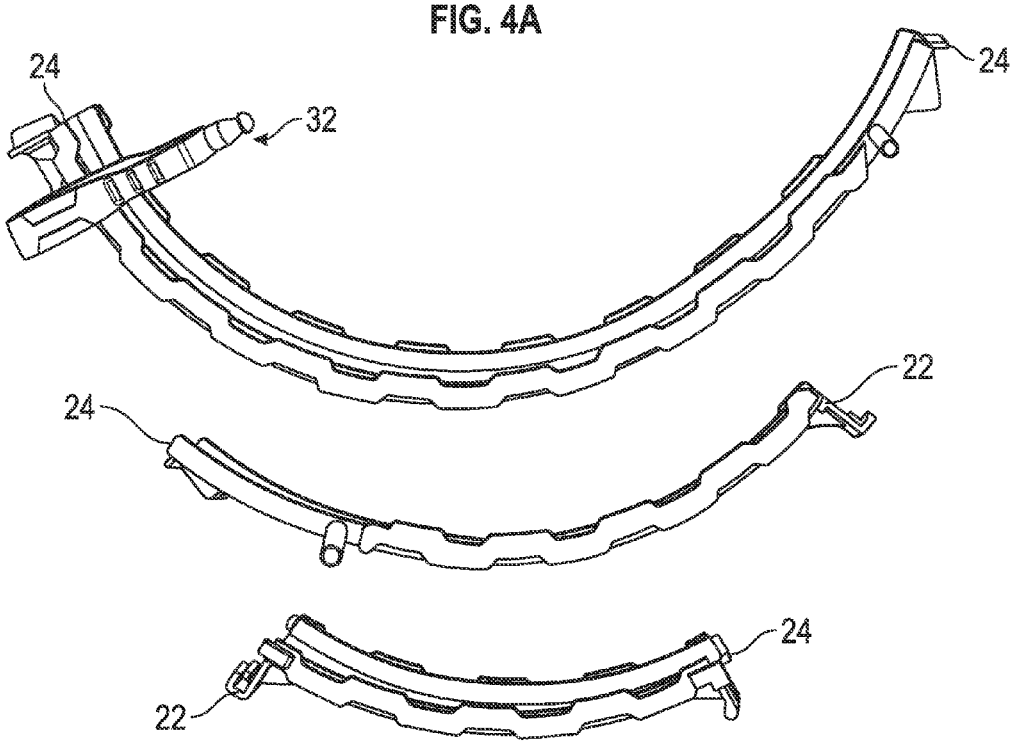
Figure 4C:
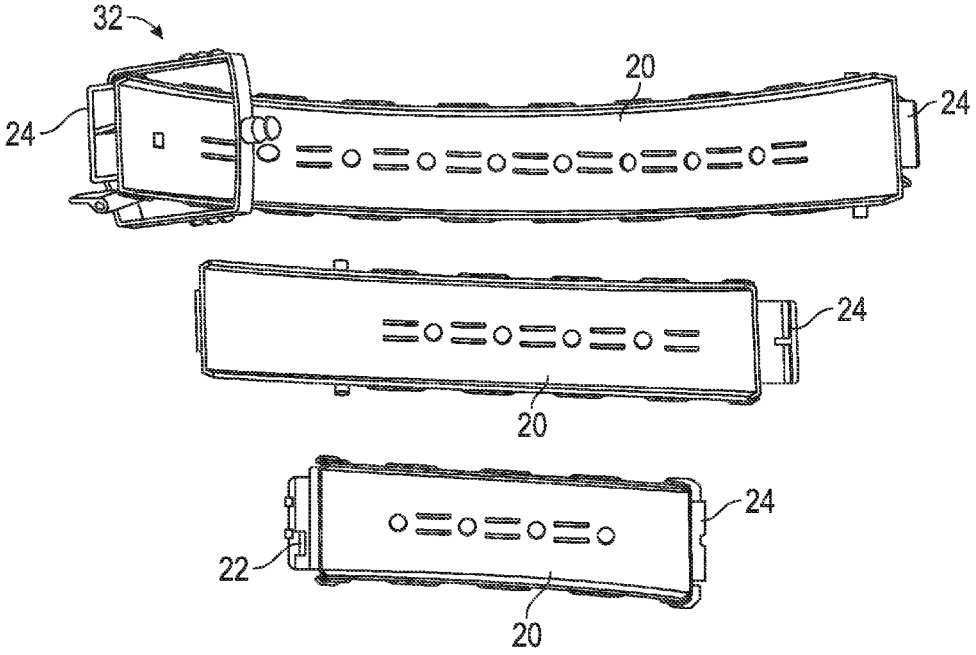
Figure 4D:
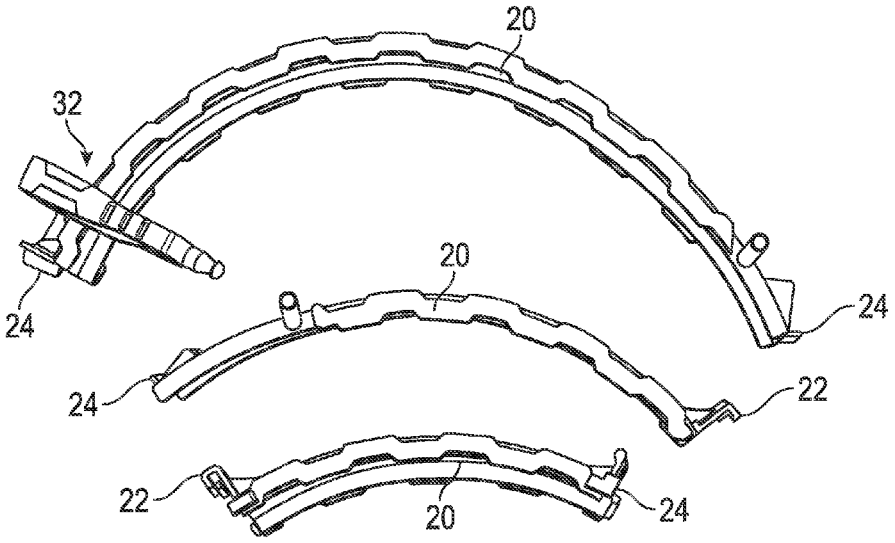
Figure 4E:
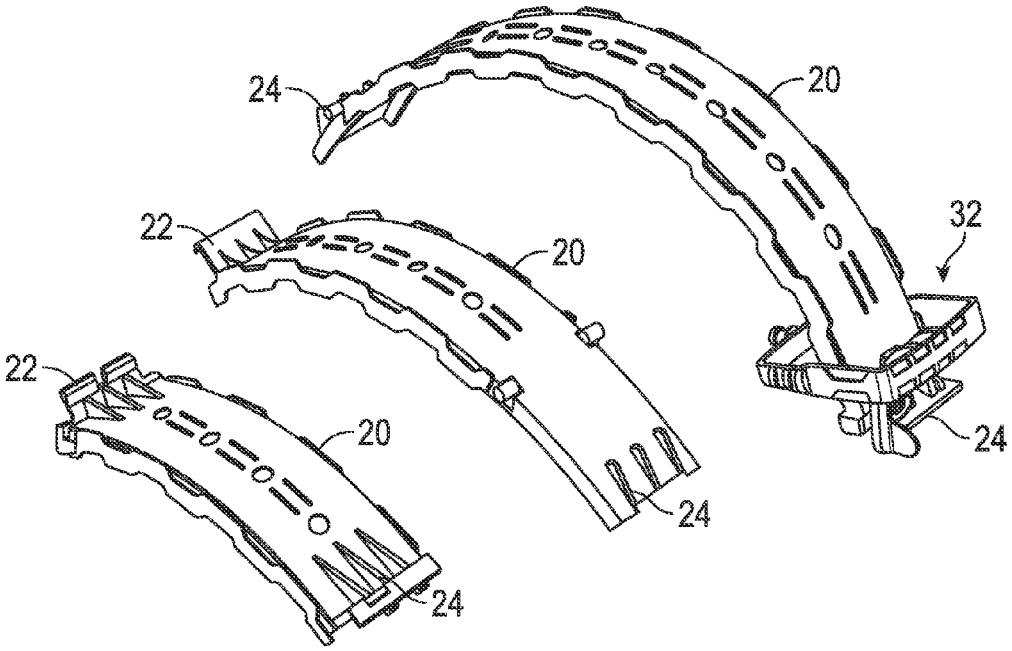
Figure 4F:
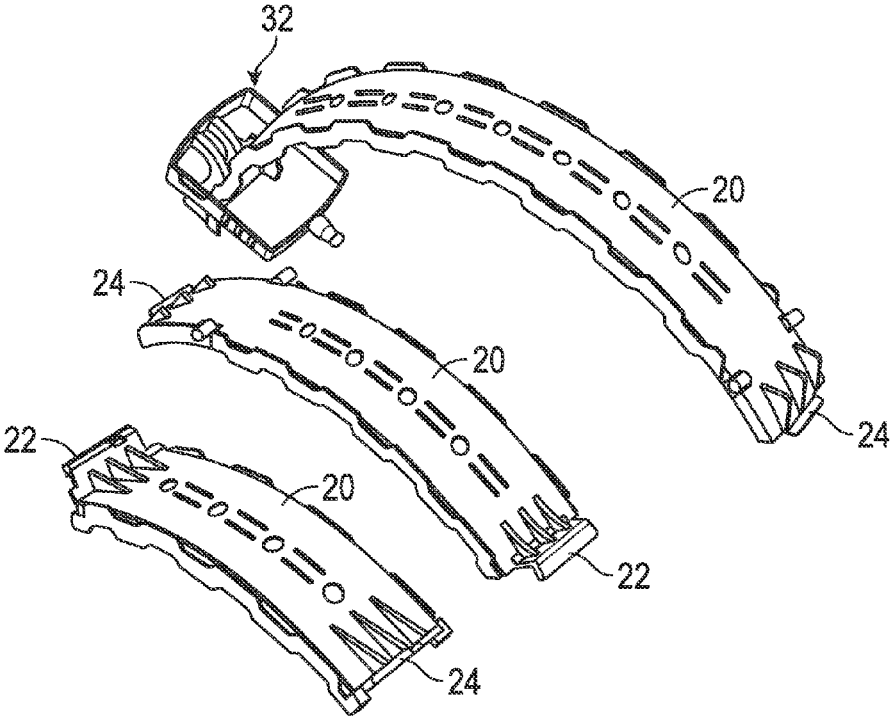

Referring back to FIG. 1, the play set 10 also has a base portion 28. Base portion 28 has openings 30 (see FIG. 3) that allow features 24 of at least two of the curved segments 20 to be releasably secured to base portion 28. In one non-limiting exemplary embodiment, the loop section 16 of the play set 10 is formed of three curved track segments 20, two of which are releasably secured to the base portion 28 at one end (e.g., feature 24 being received within opening 30) and the third one being releasably secured to the other two curved track segments 20. In this configuration, one of the curved track segments 20 is configured to have complementary features 24 on opposite ends such that one end can be received within an opening 30 of the base portion 28 and the opposite end can be received within feature 22 of another curved track segment 20. In one non-limiting embodiment, the curved track segment 20 with complementary features 24 is also configured to have a release mechanism 32 (see FIGS. 5A and 5B), which will be described below.

As illustrated in the attached FIGS. and in accordance with one non-limiting exemplary embodiment, each of the curved track segments 20 has a different length.

In order to releasably secure all of the curved track segments 20 to each other, a release mechanism 32 is provided. In one embodiment, release mechanism 32 is pivotally mounted to an end portion of one of the curved track segments 20 such that movement in the directions of arrows 34 (see FIG. 6B) is facilitated. In one embodiment, the release mechanism 32 comprises a structure 36 that extends around the curved track segment 20 to which it is pivotally secured. Accordingly, portions of the structure 36 above and below the curved track segment 20 can move in the directions of arrows 34. The structure 36 has an arm member or arm members 38 extending therefrom which are pivotally secured to the curved track segment 20 via a pin 40. Arm members 38 are configured to make contact with an edge portion 42 (see FIG. 2D) of feature 22 in order to dislodge the same from the curved segment 20 having release mechanism 32 pivotally secured thereto.

A target or contact member 44 is pivotally secured to structure 36 via an arm member 46. The pivotal securement of target 44 allows the same to move in the direction of arrows 50 such that the target 44 may be intermittently positioned in a path 52 of the track set. Accordingly, if a vehicle 12 is traveling along path 52 when the target 44 is in a blocking position (i.e., due to its movement in the direction of arrows 50) vehicle 12 will contact target 44 and cause structure 36 to move in the direction of arrow 54 (see FIG. 6B) which will cause arm members 38 to contact edge 42 and thus dislodge featured 22 of one of the curved track segments 20 from another one of the curved track segments 20, thus causing loop section 16 to explode apart. This action is illustrated in at least FIG. 1B. In one embodiment, loop section 16 explodes apart due to the release of a biasing force provided by at least one of the curved track segments 20.

Referring now to at least FIGS. 2A-2D, the assembly of the loop section 16 is illustrated. First, two curved track segments 20 are releasably secured to base member 28 via features 24 being received within openings 30. Thereafter, a third curved track segment 20 is releasably secured to the two track segments 20 previously secured to the base member 28. One end of this third curved track segment 20 is secured to the end of the curved track segment 20 having the release mechanism 32.

Each of the curved track segments 20 is configured to have a first curved configuration corresponding to a neutral or non-biasing position. This neutral or non-biasing position corresponds to when the curved track segments are not secured to each other. When the curved track segments 20 are in this neutral or non-biasing position, the radius of the arc or curvature of each one of these segments 20 is be greater than the radius of the arc or curvature of each one of the curved segments when adjacent curved segments are secured together. In other words, in order to secure the curved track segments 20 together, at least one or more of the curved track segments 20 has to be biased inwardly such that the last one of the features 24 on one segment 20 can be received within or engaged with a feature 22 on another segment 20. Accordingly, the loop section 16, when formed, will be biased outwardly such that the release of all of the curved track segments 20 can be facilitated. The release of the curved track segments 20 occurs when the release mechanism 32 is actuated by target 44. In other words, when loop section 16 is formed by securing each of the curved track segments 20 to each other, at least one or more of the curved track segments 20 are manipulated from a first non-biased or neutral position in which the curved track segment has a radius R1 to a second biased or secured position in which the curved track segment has a radius R2. Radius R2 is less than radius R1, and thus, loop section 16 is biased to be released once one of the features 22 is disengaged from a feature 24 via actuation of release mechanism 32.

In one non-limiting exemplary embodiment, each of the track segments 20 is formed from a plastic material having resilient characteristics such that it can be manipulated from a first unbiased or neutral position in which the radius of the arc segment is greater than the radius of the arc segment when the track segment 20 is manipulated into a second or biased position. Of course, any other equivalent material for facilitating the resilient characteristics of the track segments 20 is contemplated to be within the scope of exemplary embodiments of the present invention.

Figure 5A:
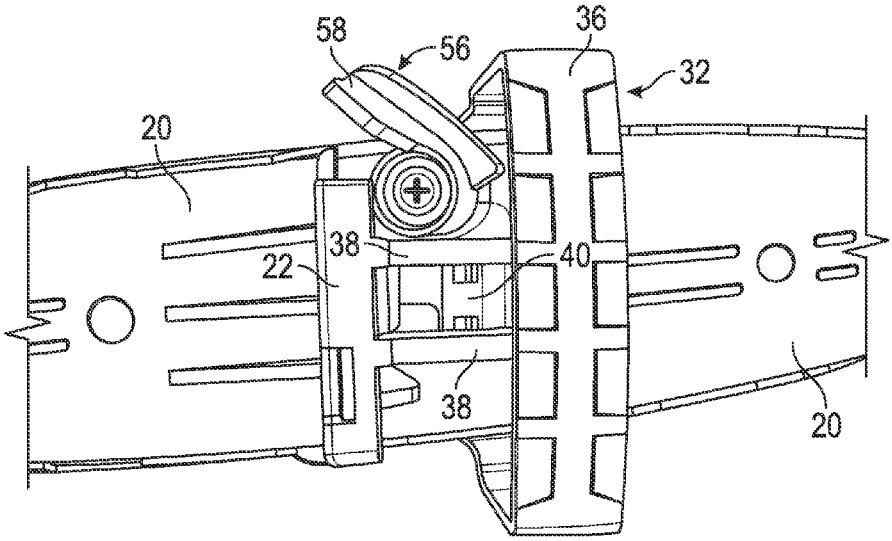
FIGS. 5A and 5B illustrate a locking mechanism of an exemplary embodiment of the present invention.
Figure 5B:
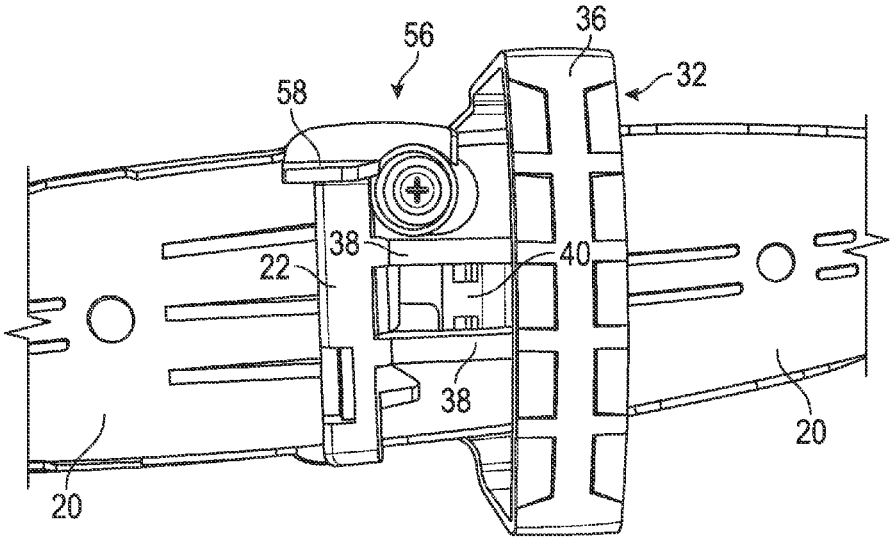

In one embodiment and referring to FIGS. 5A and 5B, one of the curved track segments 20 has a locking mechanism 56 that is capable of movement from a first non-blocking position illustrated in FIG. 5A and a second blocking position in FIG. 5B. When the locking mechanism 56 is in the second blocking position, actuation of the release mechanism 32 does not cause the loop section 16 to break apart. In one embodiment, locking mechanism 56 is a member 58 pivotally mounted to one of the curved track segments 20 and member 58 contacts or prevents movement of another one of the curved track segments 20 away from the curved track segment 20 having locking mechanism 56 pivotally secured thereto. In other words, member 58 prevents the two curved track segments 20 secured to each other from moving apart. When the locking mechanism 58 is in the second blocking position, a toy vehicle striking the target 44 will not cause actuation of the release mechanism 32. Accordingly, locking mechanism 58 allows for variations in play of the track set.

Figure 6A:
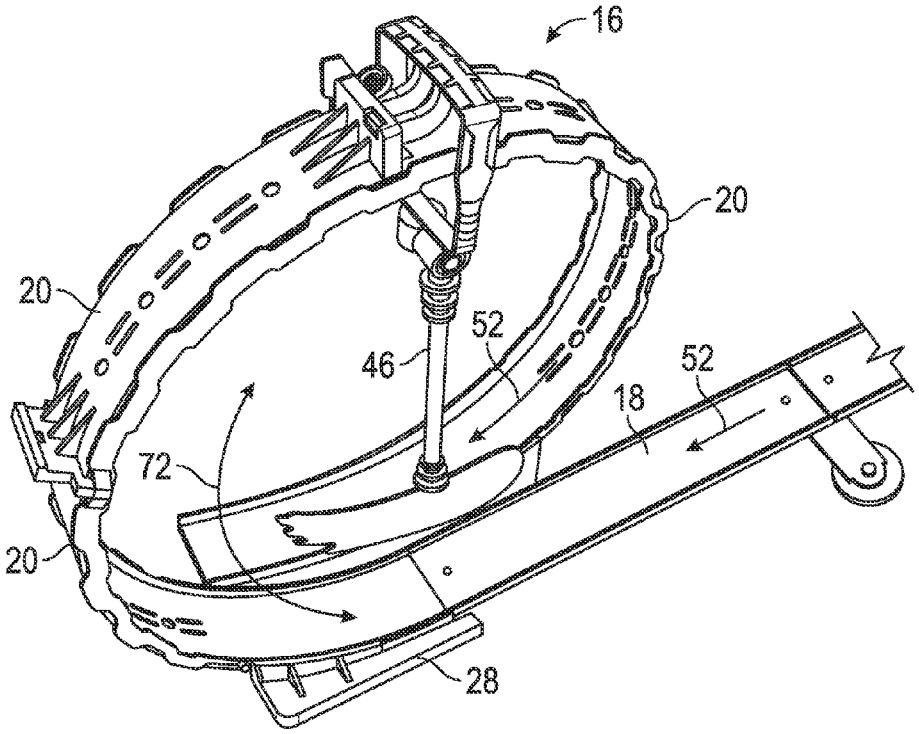
FIGS. 6A and 6B illustrate different positions of a release mechanism in accordance with an exemplary embodiment of the present invention.
Figure 6B:
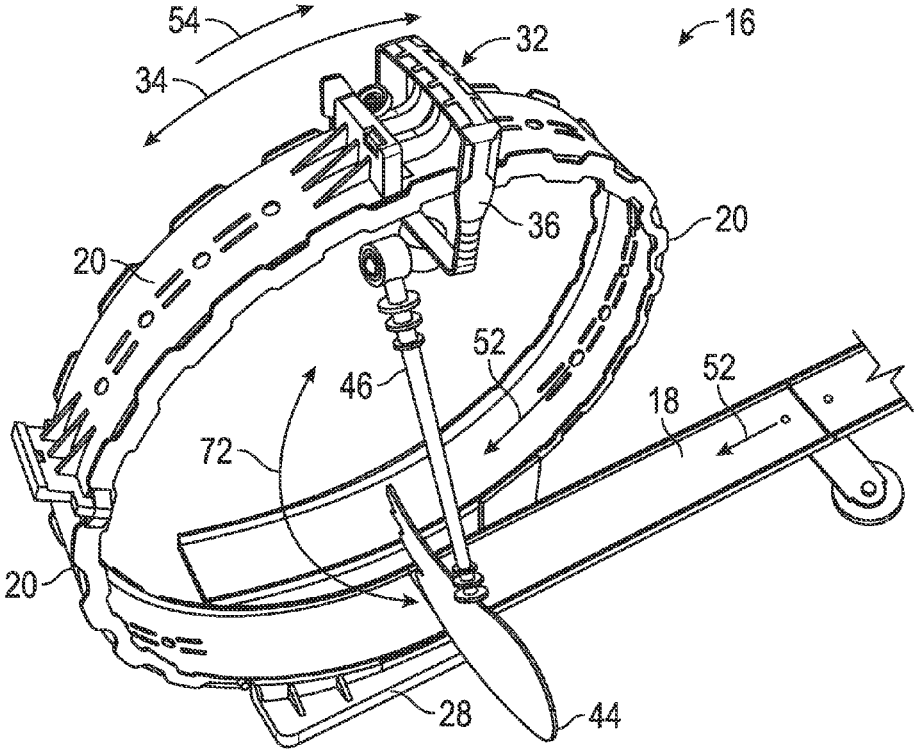

In one embodiment and referring to FIGS. 6A and 6B, arm member 46 is pivotally mounted to a collar 70 that is rotationally secured to structure 36 such that movement of collar 70, arm member 46, and target 44 in the direction of arrows 72 is possible. As illustrated, the movement in the direction of arrows 72 allows the target 44 to be positioned in a blocking configuration (see FIG. 6B) and a non-blocking configuration (see FIG. 6A). This movement allows for variations in play of the track set 10.

Figure 7:
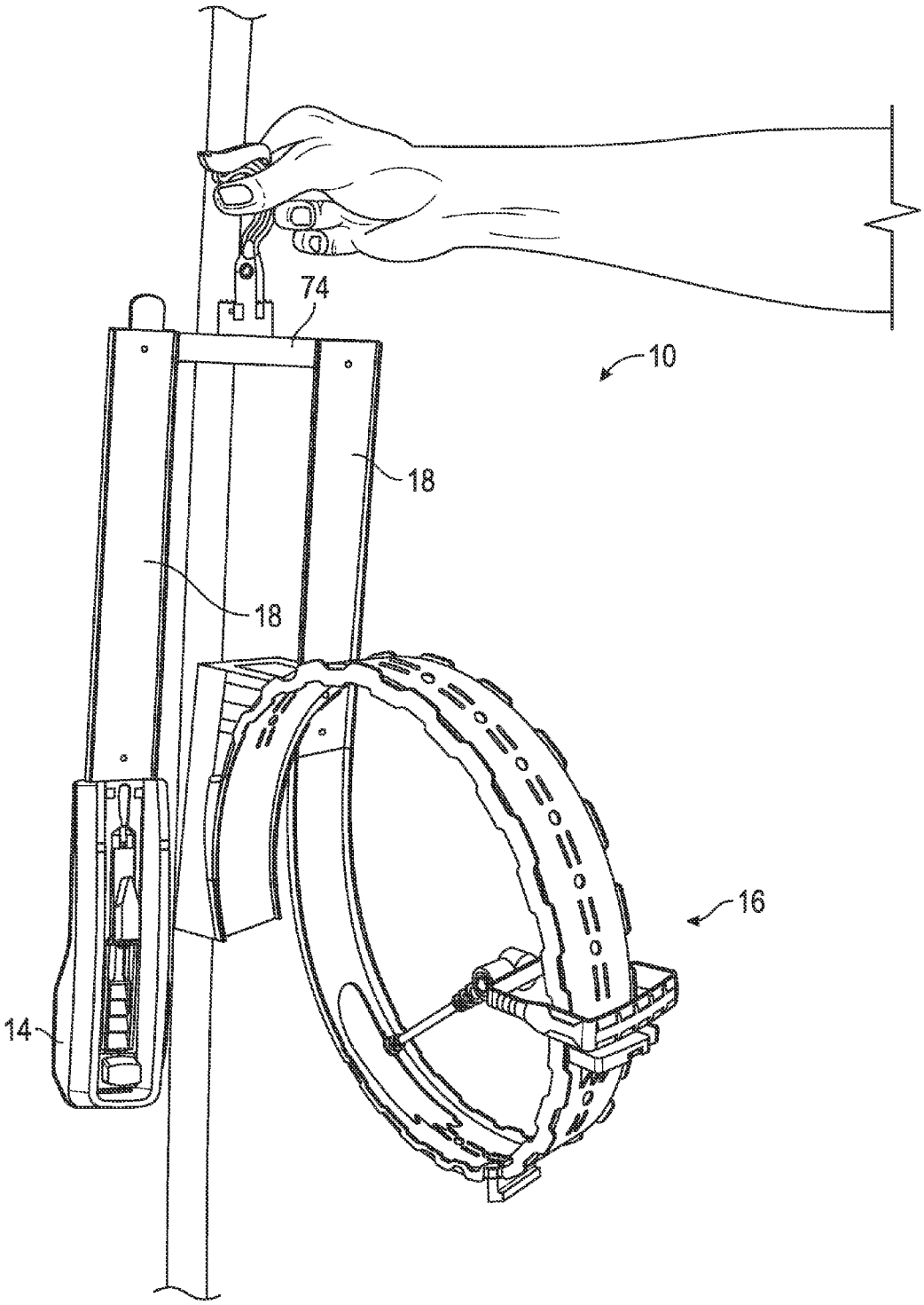
FIG. 7 illustrates the track set in a stowed position.
Figure 8A:
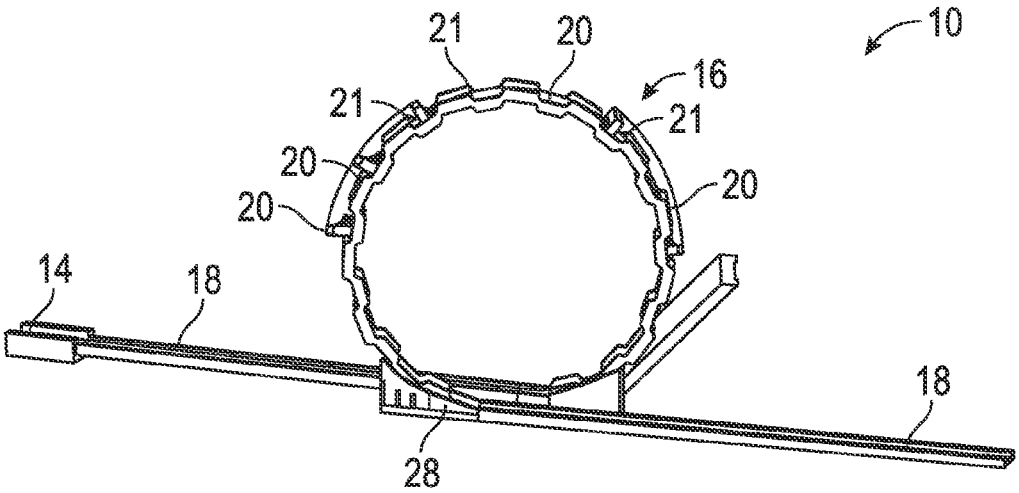
FIGS. 8A-8D illustrate an alternative embodiment of the present invention.
Figure 8B:
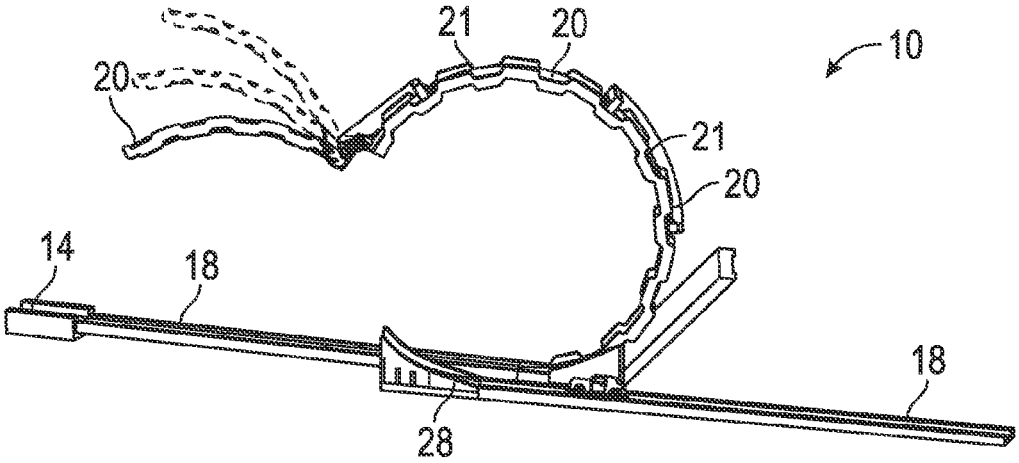
Figure 8C:
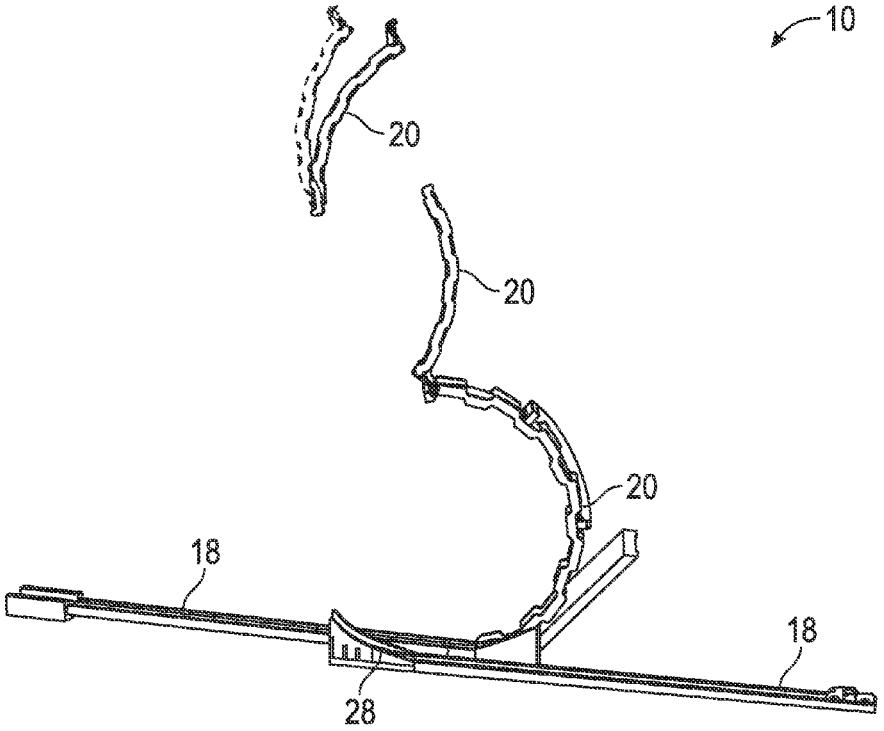
Figure 8D:
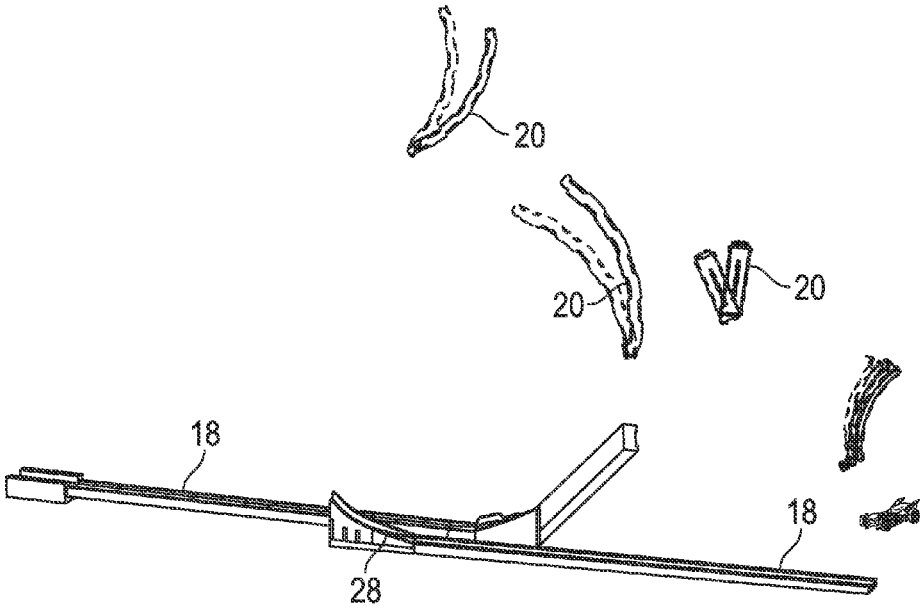

Referring now to at least FIGS. 1A and 7, the track set 10 can have several track segments 18 that extend from the launcher 14 to the base portion 28 of the loop section 16. In this embodiment, a connector 74 is provided. In one non-limiting embodiment, connector 74 is similar to the connector illustrated in co-pending U.S. patent application Ser. No. 13/486,492 filed Jun. 1, 2012, the contents of which are Incorporated herein by reference thereto. Connector 74 is configured to be positionable between a first position FIG. 1A wherein track segments 18 are secured to each other to define a portion of path 52 and a second position wherein track segments 18 no longer defined path 52 but are still secured to each other via connector 74 such that storage of the track set 10 is possible.

FIGS. 8A-10 illustrate an alternative embodiment of the present invention. In this embodiment, a release mechanism 80 (see FIG. 10) is located in the base member 28 such that a toy vehicle or object 12 traveling along a path 52 will actuate mechanism 80 when the toy vehicle 12 has traversed through the loop portion 16. In this embodiment, release of the curved track segments 20 from each other occurs in a relatively slow sequential blow-apart "explosion" of the circular loop 16 after actuation of mechanism 80. In other words, actuation of mechanism 80 causes a first one of the curved track segments to be released from the base member 28 and thereafter each one of the curved track segments is sequentially released from each other until the last one is released from the base member 28.

In this embodiment, the loop section 16 is made up of several curved track segments 20 which have a rotary interlock with each other and are individually preloaded with a spring or rubber band 21 in order to provide a biasing force for the sequential release of the track segments 20.

In order to define the loop section 16 a first one of the track segments 20 is attached to the base member 28, then the remaining segments are sequentially assembled to form a loop, and the final segment plugs into a trigger part or mechanism 80 mounted on the base member 28. Once mechanism 80 is triggered, the last segment used to form the loop is released first to fly upwards first relative to the base member 28. Once that segment is released, the next segment is free to fly upwards, and so on, in reverse order of assembly. The rotary interlock on the segments uses the mass of the segments 20 to ensure that the segments "explode" sequentially domino style with a short delay. This result is visibly different than all the segments exploding simultaneously.

Figure 9:
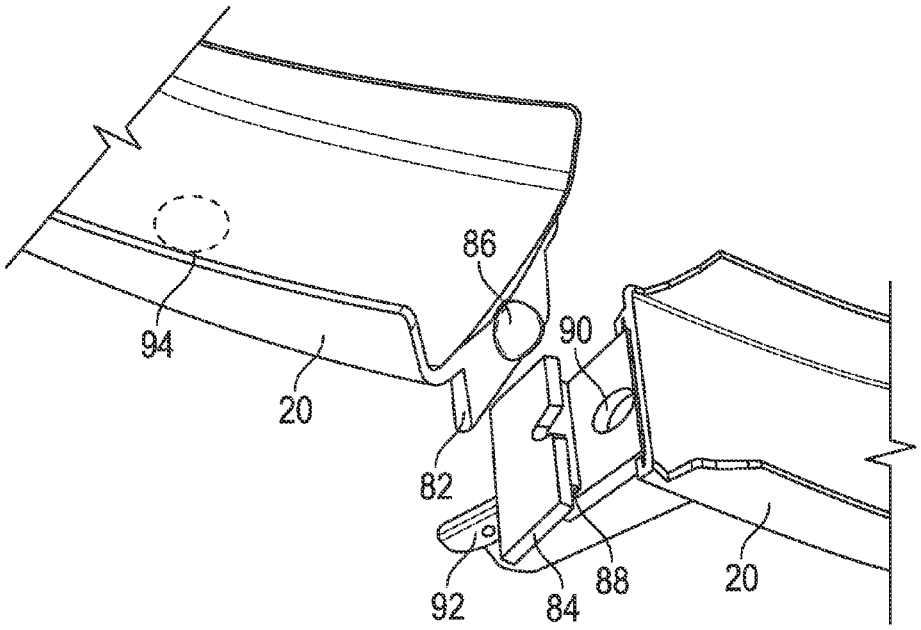
FIG. 9 illustrates a partial view of curved segments of the embodiment illustrated in FIGS. 8A-8D.

FIG. 9 illustrates the rotary interlock for use in securement of two of the curved track segments 20 to each other. In this embodiment, a feature 82 of a first track segment 20 is configured to be received within a feature 84 of another track segment 20. In one embodiment, feature 82 may comprise a tab with a protrusion 86 wherein the tab is received within a channel 88 of feature 84 and protrusion 86 is received within an opening 90 of feature 84.

Features 82 and 84 are configured such that the two curved track segments 20 secured to each other by features 82 and 84 are capable of being rotatably secured to and released from each other such that the sequential release or explosion of the loop section 16 is possible.

Also shown is that feature 84 includes a hook or member 92 configured to receive one end of a biasing member or spring 21 and the other end of the biasing member or spring 21 is secured to a feature 94 (illustrated by the dashed lines in FIG. 9) such that when the first track segment 20 is released, each of the biasing members 21 will cause the curved track segments 20 to sequentially rotate away from each other.

Figure 10:
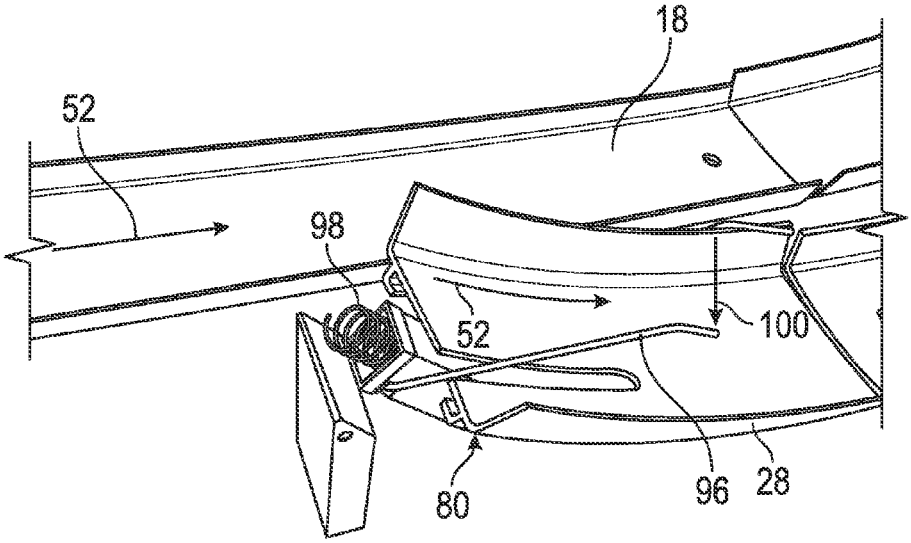
FIG. 10 illustrates a base segment of the embodiment illustrated in FIGS. 8A-8D.

FIG. 10 illustrates the release mechanism 80 configured to release the first one of the curved track segments 20 when release mechanism 80 is actuated by a vehicle traveling along path 52. An arm member 96 is coupled to a spring or biasing member 98 such that when arm member is pushed downwardly in the direction of arrow 100 by a vehicle 12 traveling along path 52, the spring member 98, which is compressed by a feature 82 or protrusion 86 of one of the curved track segments 20 is released and thus a first one of the curved track segments 20 is released from the loop section 16. Thereafter, the biasing members 21 will cause each subsequent interlock of a pair of curved track segments 20 via features 82 and 84 to be released in a sequential manner. (See for example FIGS. 8A-8D.)

Figure 11A:
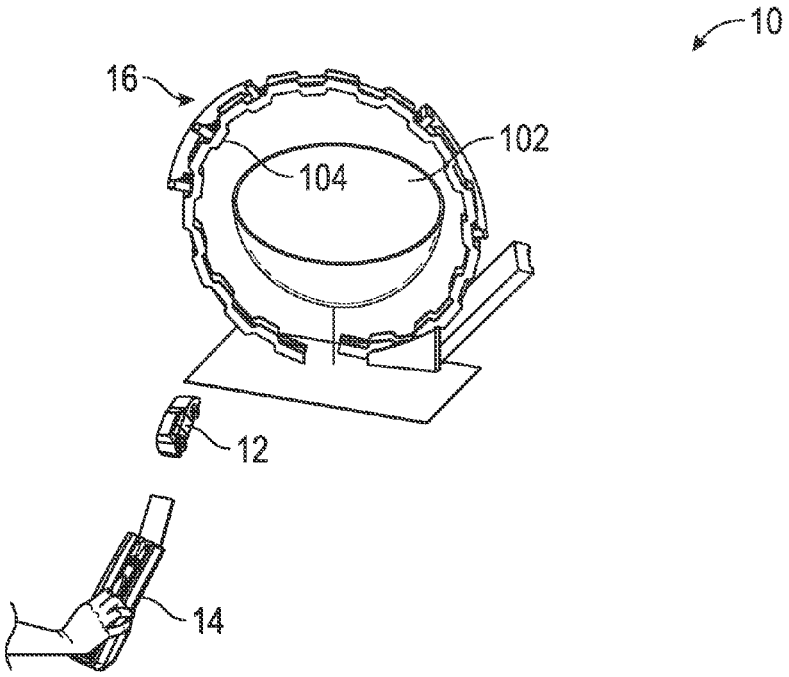
FIGS. 11A and 11B illustrate yet another alternative embodiment of the present invention.
Figure 11B:
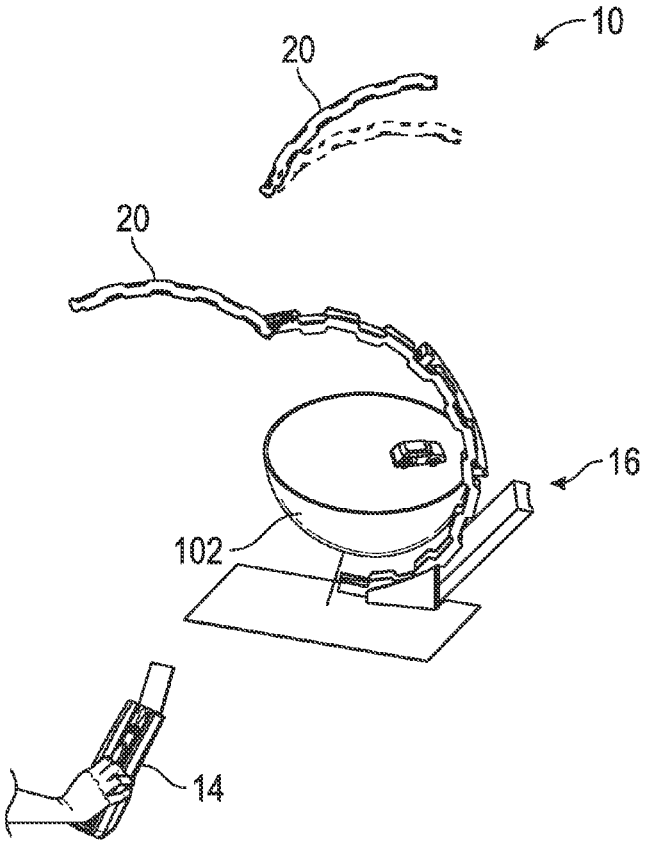

Referring now to FIGS. 11A and 11B, yet another alternative exemplary embodiment of a track set 10 according to the present invention is illustrated. Here, the release mechanism 80 is coupled to a target 102 located within an opening 104 defined by the loop section 16. In this embodiment, launcher 14 is configured to launch the toy vehicle 12 into the opening 104 and if the target 102 of release mechanism 80 is struck, the track segments 20 are released in similar fashion to those illustrated in FIGS. 8A-10. This mechanism is suited for many various applications, among which is that the loop segment 16 explodes after a car rolls through it. Alternatively, the loop segment 16 can be reconfigured to resemble a "ring of fire" which explodes after a car 12 jumps through it. Still further, the loop section 16 illustrated in FIGS. 1-7 may be used in conjunction with the configuration illustrated in FIGS. 11A and 11B.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A track set for toy vehicles, comprising:

a base member;

a loop section, including a loop entrance and a loop exit, defined by a plurality of curved segments, each of the curved segments being releasably secured to at least another one of the curved segments at one end when the loop section is defined by the curved segments, each of the curved segments includes a feature at the one end for engagement with another one of the curved segments or the base member of the track set; and a release mechanism being movably secured to the loop section between the loop entrance and the loop exit, the release mechanism being capable of movement between a first position in which the curved segments are secured to each other and a second position in which the curved segments are released from each other, wherein a portion of the release mechanism is positionable in a portion of a path defined by the loop section such that an object travelling along the path can move the release mechanism from the first position to the second position.

2. The track set as recited in claim 1, wherein at least two of the curved segments are secured to the base member at separate locations and the release mechanism is configured to releasably secure two of the curved segments to each other.

3. The track set as recited in claim 1, wherein each curved segment has a feature at one end that is configured to be releasably secured to a feature of another curved segment.

4. The track set as recited in claim 1, wherein the release mechanism is configured to releasably secure two of the curved segments to each other.

5. The track set as recited in claim 4, wherein the release mechanism includes a structure pivotally mounted to one of the curved segments and an arm member, and movement of the structure causes the arm member to contact the feature of one of the curved segments.

6. The track set as recited in claim 5, further comprising a locking mechanism configured for movement between a first non-blocking position and a second blocking position, wherein the locking mechanism, in the second blocking position, prevents the curved segments from being released from each other.

7. The track set as recited in claim 5, wherein the release mechanism includes a target pivotally secured to the structure via an arm member, wherein the target is capable of being located in a blocking position and in an unblocking position with respect to the path.

8. The track set as recited in claim 7, wherein the arm member is pivotally mounted to a collar that is rotatably secured to the structure.

9. The track set as recited in claim 6, wherein the locking mechanism is a member pivotally mounted to one of the curved segments.

10. The track set as recited in claim 1, wherein each of the curved segments has a first curved configuration corresponding to an non-biasing position and a second curved configuration corresponding to a biasing position, and the radius of curvature of the curved segments in their non-biasing positions is greater than the radius of curvature of the curved segments in their biasing positions.

11. The track set as recited in claim 10, wherein each curved segment is in its second curved configuration when the curved segments are secured to each other.

12. A track set for toy vehicles, comprising:

a loop section defined by a plurality of curved segments each being releasably secured to each other, each of the curved segments being releasably secured to at least another one of the curved segments at one end when the loop section is defined by the curved segments, each of the curved segments including a feature at the one end for engagement with another one of the curved segments;

a base member; and a trigger mechanism mounted on the base member, the trigger mechanism being configured to release a first one of the plurality of curved segments from the base member such that each one of the plurality of curved segments sequentially dislodges from each other.

13. The track set as recited in claim 12, wherein each curved segment is configured to interlock with another curved segment in a rotary fashion, and each curved segment has a biasing member configured to provide a biasing force for rotating the curved segments away from each other when the trigger mechanism is actuated.

14. The track set as recited in claim 13, wherein each of the curved segments includes features configured to be rotatably secured to each other.

15. The track set as recited in claim 12, wherein the trigger mechanism is located on a track path partially defined by the base member.

16. The track set as recited in claim 12, wherein the trigger mechanism is in an opening defined by the loop section.

17. A toy vehicle track set comprising:

a base member;

a loop section removably coupled to the base member, the loop section including a first curved track segment, a second curved track segment, and a third curved track segment, the first curved track segment removably coupled at one end to the base member, the third curved track segment removably coupled at one end to the base member, the second curved track segment removably coupled to the first curved track segment and to the third curved track segment, the loop section including a biasing member;

a trigger mechanism coupled to the base member, the trigger member being engageable by a toy vehicle, wherein actuation of the trigger member by a toy vehicle results in the release of the track segments and the track segments move apart due to the force of the biasing member.

18. The toy vehicle track set as recited in claim 17, wherein each of the curved track segments includes a coupler that is engageable with a coupler on another curved track segment, and engaged couplers disengage from each other in response to actuation of the trigger mechanism.

19. The toy vehicle track set as recited in claim 17, further comprising:

a locking mechanism coupled to one of the curved track segments, wherein the locking mechanism is movable between a first position in which the locking mechanism prevents coupled curved track segments from separating and a second position in which the locking mechanism permits coupled curved track segments to separate.

20. The toy vehicle track set as recited in claim 19, wherein the locking mechanism includes a member that is pivotally coupled to one of the curved track segments.

* * * * *